US011661872B2

(12) United States Patent
Laigle et al.

(10) Patent No.: US 11,661,872 B2
(45) Date of Patent: May 30, 2023

(54) REDUCTION OF INTERNAL COMBUSTION ENGINE EMISSIONS WITH IMPROVEMENT OF SOOT FILTRATION EFFICIENCY

(71) Applicant: SAUDI ARABIAN OIL COMPANY, Dhahran (SA)

(72) Inventors: Emmanuel Laigle, Courbevoie (FR); Christophe Chaillou, Rueil-Malmaison (FR); Caroline Norsic, Rueil-Malmaison (FR); André Nicolle, Nanterre (FR)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/144,535

(22) Filed: Jan. 8, 2021

(65) Prior Publication Data

US 2022/0220875 A1 Jul. 14, 2022

(51) Int. Cl.

| | |
|---|---|
| ***F01N 3/035*** | (2006.01) |
| ***F01N 3/031*** | (2006.01) |
| ***F01N 3/022*** | (2006.01) |
| *F01N 3/023* | (2006.01) |

(52) U.S. Cl.

CPC ..... *F01N 3/035* (2013.01); *F01N 3/0222* (2013.01); *F01N 3/023* (2013.01); *F01N 3/031* (2013.01); *F01N 2250/02* (2013.01); *F01N 2510/06* (2013.01); *F01N 2900/1606* (2013.01)

(58) Field of Classification Search

CPC ..... F01N 3/031; F01N 3/035; F01N 3/0222; F01N 3/023; F01N 2900/1606; F01N 2510/06; F01N 2250/02; F01N 13/0093; F01N 2330/48; F01N 2410/00; F01N 2560/02; F01N 2900/1611; F01N 3/021; F01N 3/10

See application file for complete search history.

(56) References Cited

U.S. PATENT DOCUMENTS

| | | | |
|---|---|---|---|
| 4,702,075 | A | 10/1987 | Jenny |
| 7,735,314 | B2 | 6/2010 | Lu et al. |
| 8,161,732 | B2 | 4/2012 | Peters et al. |

(Continued)

FOREIGN PATENT DOCUMENTS

| | | | |
|---|---|---|---|
| CH | 665002 | A5 | 4/1988 |
| CN | 108223060 | A | 6/2018 |

(Continued)

*Primary Examiner* — Phutthiwat Wongwian
*Assistant Examiner* — Diem T Tran
(74) *Attorney, Agent, or Firm* — Osha Bergman Watanabe & Burton LLP

(57) ABSTRACT

An exhaust purification system may include at least one catalyst in an exhaust flow path of an internal combustion engine to decrease gaseous pollutants from an exhaust gas, a first particulate filter downstream of the catalyst, and a second particulate filter with a porosity lower and a lower mean pore size than the first particulate filter and in a bypass flow line downstream of the first particulate filter, the bypass flow line being configured to open and close based on at least one condition of the exhaust purification system or conditions of the exhaust gas. The second particulate filter may be configured to be removed and replaced when full. A method of purifying an exhaust gas through the exhaust purification system is also described.

7 Claims, 6 Drawing Sheets

(56) References Cited

U.S. PATENT DOCUMENTS

| | | | | |
|---|---|---|---|---|
| 9,482,125 | B2 | 11/2016 | Gonze et al. | |
| 10,072,551 | B2 | 9/2018 | Uchiyama et al. | |
| 10,590,827 | B2 | 3/2020 | Ulrey et al. | |
| 2008/0271439 | A1 | 11/2008 | Londos | |
| 2014/0366515 | A1 | 12/2014 | Kowalkowski et al. | |
| 2017/0102311 | A1* | 4/2017 | Zhang | F01N 3/021 |
| 2018/0353905 | A1* | 12/2018 | Li | F01N 13/009 |
| 2019/0017423 | A1* | 1/2019 | Martin | F01N 9/002 |

FOREIGN PATENT DOCUMENTS

| | | | |
|---|---|---|---|
| DE | 102017102098 | A1 | 8/2017 |
| JP | 2005330936 | * | 12/2005 |
| WO | 2006125928 | A1 | 11/2006 |

* cited by examiner

REDUCTION OF INTERNAL COMBUSTION ENGINE EMISSIONS WITH IMPROVEMENT OF SOOT FILTRATION EFFICIENCY

BACKGROUND

While complete combustion of fuels would only produce carbon dioxide and water, engines are not completely efficient. In particular, internal combustion engines emit gaseous pollutants such as carbon monoxide (CO), carbon dioxide ($CO_2$), unburned hydrocarbon, nitrogen oxide ($NO_x$) as well as solid pollutants such as particulate matter. As legislation has tightened the rules for vehicle emissions, new exhaust purification systems have been developed to reduce particulate emission. Most of the exhaust lines for internal combustion engines include one or more catalysts to reduce gaseous pollutants, while solid pollutants (also called soot) are removed by a particulate filter.

Conventional exhaust gas treatment systems include a catalytic converter in line with a particulate filter, such as a diesel particulate filter, to collect the particulate matter from the exhaust gas. A pressure sensor may also be included in the exhaust gas treatment system to detect the pressure associated with the particulate filter. The pressure detected by the pressure sensor varies according to the accumulation of particulate matter or soot in the particulate filter and/or a damaged particulate filter.

Referring now to FIG. 1, an engine system 16 may include an internal combustion engine 18 such as a compression ignition diesel engine coupled to an exhaust particulate filter system 20. Exhaust particulate filter system 20 includes an exhaust particulate filter 22 fluidly connected with engine 18 to trap particulates such as soot and ash in engine exhaust. Filter 22 may include a canister or housing 24 having an exhaust inlet 25 fluidly connected with an exhaust conduit 28 coupled with engine 18 in a conventional manner, and an exhaust outlet 27 coupled with an outlet conduit 32, in turn connecting with an exhaust stack or tailpipe (not shown) in a conventional manner. A regeneration mechanism 34 is positioned fluidly between engine 18 and filter 22 to enable regeneration of filter 22. A diesel oxidation catalyst (not shown) may also be located fluidly between engine 18 and filter 22. A filter medium 26 is positioned within housing 24 and configured for trapping particulates such as soot and ash in exhaust from engine 18. Filter system 20 may further include a control system 40 for filter 22.

An example of an exhaust gas treatment is the 4-way catalyst exhaust after-treatment system that has been widely used to meet the more stringent environmental regulations for light and heavy duty diesel engine. The 4-way catalyst system is composed of a diesel oxidation catalyst, a diesel particulate filter, and a lean NOx trap or selective catalytic reduction device. The diesel particulate filter can be catalyzed or non-catalyzed. This combination of devices is called a "four-way catalyst" system because in addition to converting carbon monoxide, hydrocarbons and nitrogen oxides, it reduces the amount of soot particles, as a fourth component.

The performance of each component is significantly dependent on its temperature. The average catalytic converter typically begins to function at approximately 600° C. so the converter provides minimal emission reduction during the warm up period. Therefore, internal combustion engines emit the most pollutants during engine cold start and a warm up period.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments of the present disclosure are directed to a dynamic exhaust system that increases the filtering of soot from the exhaust depending on the conditions of the exhaust gas. The dynamic exhaust system includes a catalyst, a first particulate filter downstream of the catalyst, and a second particulate filter located in a bypass flow line downstream of the first particulate filter.

In one or more embodiments, the second particulate filter is configured to be removed and replaced when full (or having a predetermined quantity of soot present therein).

In another aspect, embodiments disclosed herein relate to a method of purifying the exhaust gas through the exhaust purification system. The catalyst in the exhaust purification system decreases gaseous pollutants. The first particulate filter decreases a quantity of solid pollutants from the exhaust gas downstream of a combustion reaction. The bypass flow line, wherein the second particulate filter is located, is opened to filter a second quantity of solid pollutants from the exhaust gas or closed based on at least one of conditions of the exhaust purification system or conditions of the exhaust gas.

Other aspects and advantages of this disclosure will be apparent from the following description made with reference to the accompanying drawings and the appended claims.

DETAILED DESCRIPTION

Embodiments of the present disclosure are directed to exhaust purification systems used to reduce the quantity of particulate matter emitted from internal combustion engines. In particular, embodiments of the present disclosure are directed to a dynamic exhaust system that increases the filtering of soot from the exhaust depending on the conditions of the exhaust gas. Such increase in filtering may occur through a bypass flow line that opens and closes depending on such exhaust gas conditions.

Figure 2:
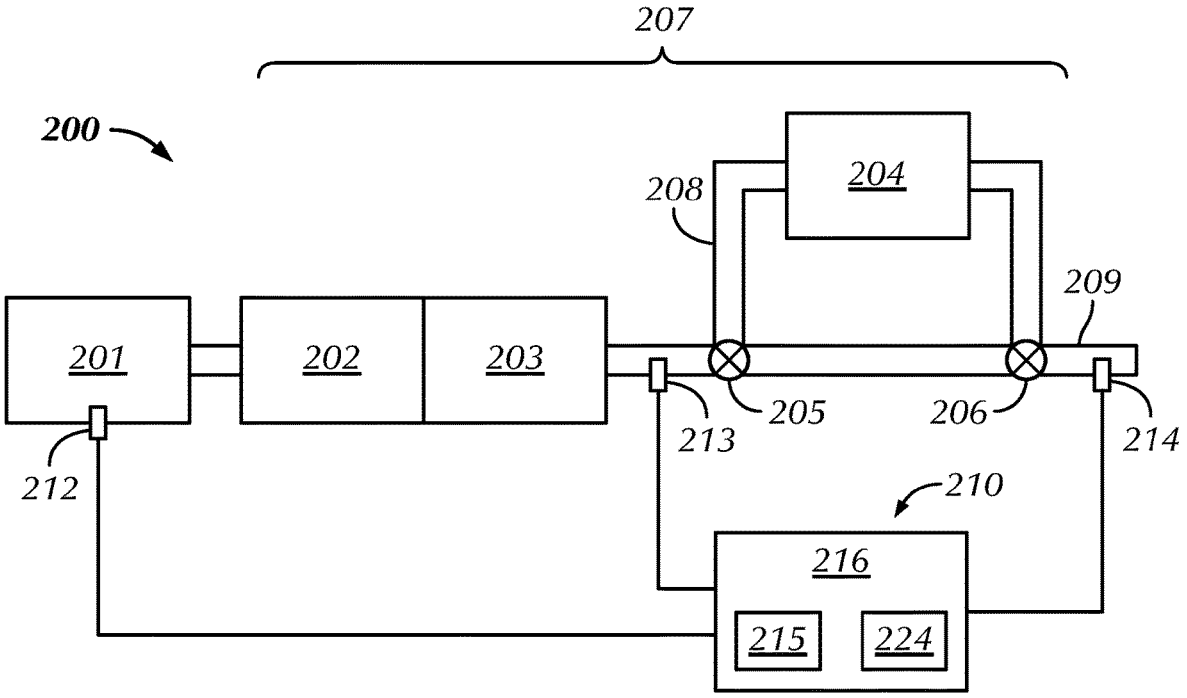
FIG. 2 is a schematic of the exhaust purification system.

FIG. 2 represents an exemplary exhaust purification system of one or more embodiments.

As shown, an engine system 200 includes an internal combustion engine 201 and an exhaust purification system 207, which receives the exhaust from the internal combustion engine 201. Exhaust purification system 207 decreases pollutants from an exhaust gas of the internal combustion engine. Pollutants may be reduced by a catalyst 202 (reducing gaseous pollutants) and a first particulate filter 203 downstream of the catalyst 202. The first particulate filter 203 is provided to decrease solid pollutants from the exhaust gas. In addition to the first particulate filter 203, the exhaust purification system 207 also includes a second particulate filter 204 located in a bypass flow line 208 downstream of the first particulate filter 203.

The catalyst 202 may be a catalytic converter that oxidizes carbon monoxide to carbon dioxide, unburnt hydrocarbons to carbon dioxide and water, and reduces nitrogen oxides into nitrogen. Catalytic converters use a temperature of about 400° C. for spark ignition engine and 200° C. for compression ignition engine, for example, to convert efficiently these toxic gases into inert gases.

Figure 3:
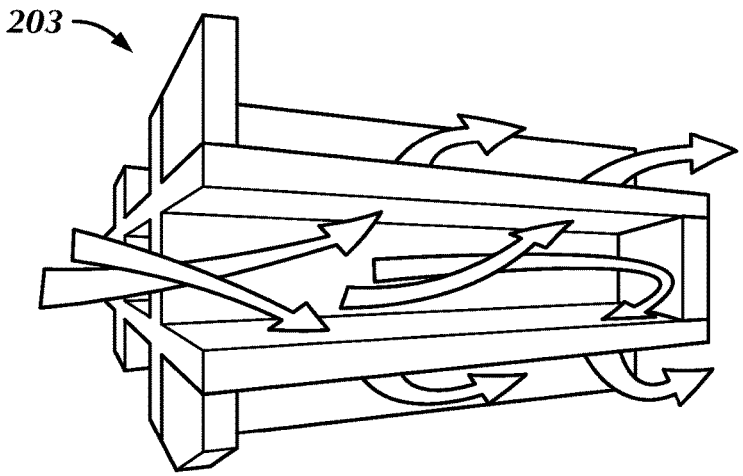
FIG. 3 is a drawing of the first particulate filter.

The particulate filter 203 may be a gasoline particulate filter or a diesel particulate filter, depending on the type of engine being used. The present disclosure is not limited, and both types of particulate filters work in a similar way. As shown in FIG. 3, the filter 203 may have a honeycomb structure, which may be made, for example, from cordierite, a synthetic ceramic, with alternately sealed inlet and outlet channels. However, any of a wide variety of different filter media types, such as a ceramic filter medium like cordierite, a silicon carbide filtration medium, or still another type of filter medium may be used without departing from the scope of the present disclosure. It is also envisioned that the particulate filter may include a catalyst material therein.

Figure 4:
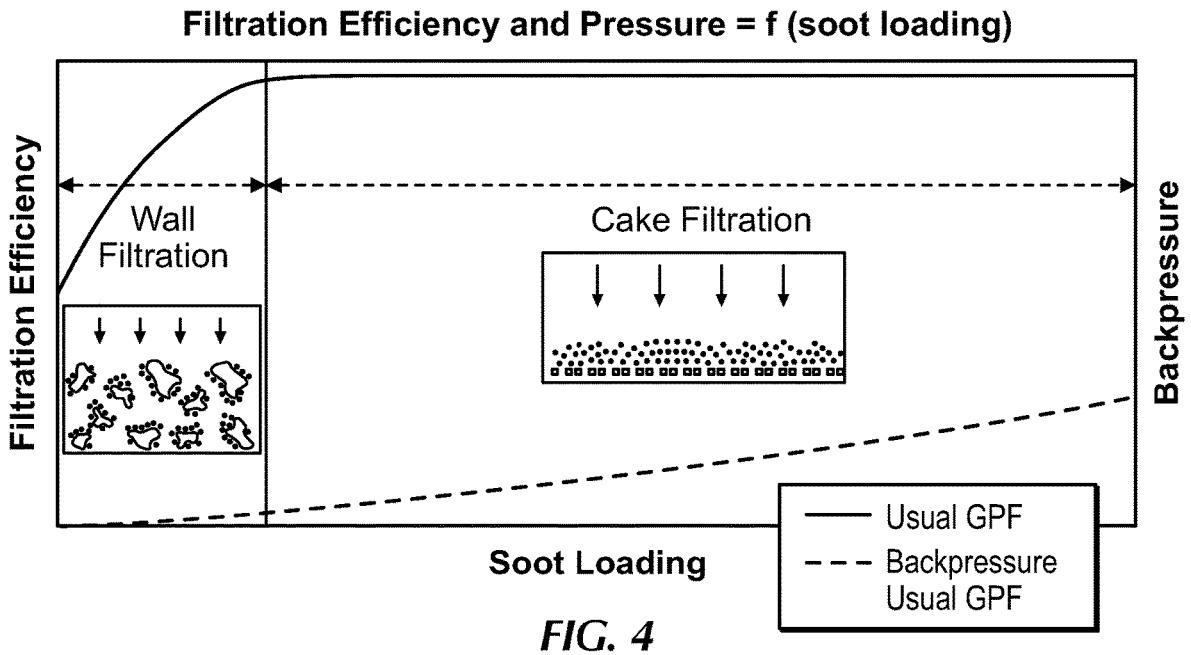
FIG. 4 shows the filtration efficiency as a function of soot loading.

In use, the exhaust gas is forced to flow through the porous filter substrate, which traps the soot. The canal density for the particulate filter, including both gasoline and diesel particulate filters may range, for example, from about 200 to 350 channels per square inch. The major difference between the two types of filter is that the porosity of the gasoline particulate filter is higher because the substrate is lighter. Although this allows the gas to move more easily across the substrate, it also means the gasoline particulate filter is more fragile than a diesel particulate filter. Particulate filters are very efficient and can remove more than 90% of particulate emissions. FIG. 4 describes the filtration efficiency of a particulate filter as a function of soot loading. For a given volumetric flow, the filtration efficiency can be split into two parts:

(1) When the filter is empty, the efficiency is reduced because the filtration is achieved using only the porosity of the filter. That phenomenon is called "wall filtration" in FIG. 4. Then, as the filter stores additional soot, the wall is filled, and it becomes more and more difficult for soot to cross the filter without being stopped. While the filtration efficiency increases, the backpressure of the filter also increases.

(2) When the wall is fully loaded of soot, the soot is now stored inside the inlet channels, forming a soot cake. That phenomenon is called "cake filtration" in FIG. 4. While the cake filtration stage is the most efficient configuration to store soot, a large pressure drop is created. The dashed line in FIG. 4 shows the constant increase in backpressure in a particulate filter as time of operation increases. This can disturb the engine, reduce its power and increase fuel consumption. Therefore, generally, the choice of a particulate filter is a compromise between filtration efficiency and backpressure, which is a function of volumetric flow. Each particulate filter has a Particulate Mass limit and a Particulate Number (PN) limit. For a given soot loading inside the particulate filter, the pressure drop increases with volumetric flow.

In one or more embodiments, soot may be removed from the first particulate filter by burning it off in-situ in the presence of oxygen and at temperatures above 600° C., in a process known as regeneration. Unlike diesel engines, where oxygen is in excess, gasoline engines generally run at stoichiometric mixture, which means there is no oxygen in the exhaust to burn off the soot when the engine is under high load. Consequently, for gasoline engines, regeneration can only be effective for non-power conditions, i.e., under deceleration, when the engine is being motored, which results in oxygen being pumped through the engine. Another major difference in gasoline engines is that the regeneration is passive, i.e. there is no need to increase the exhaust temperature on purpose. To initiate regeneration, the catalyst converter may be fed with air for short periods. This oxygen, combined with high exhaust temperatures (400-700° C.), leads to soot ignition. Where engines operate for long periods without deceleration, for example driving on a traffic-free motorway without any downhill slopes, engine control may be required to initiate regeneration. In this case, the exhaust temperature may be increased by delaying the spark timing and oxygen may be made available by creating a lean fuel/air mixture.

Figure 1:
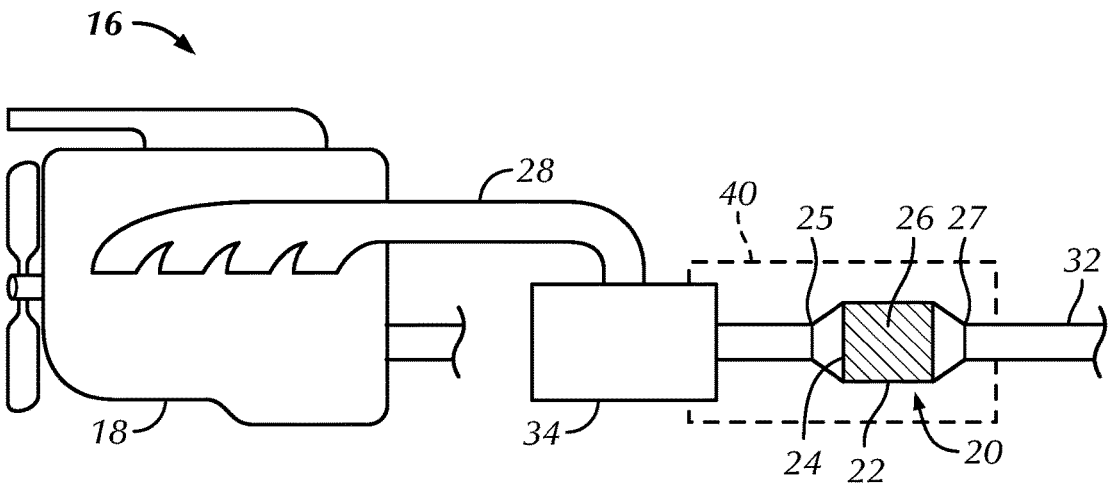
FIG. 1 is a schematic of a conventional engine system.
Figure 5:
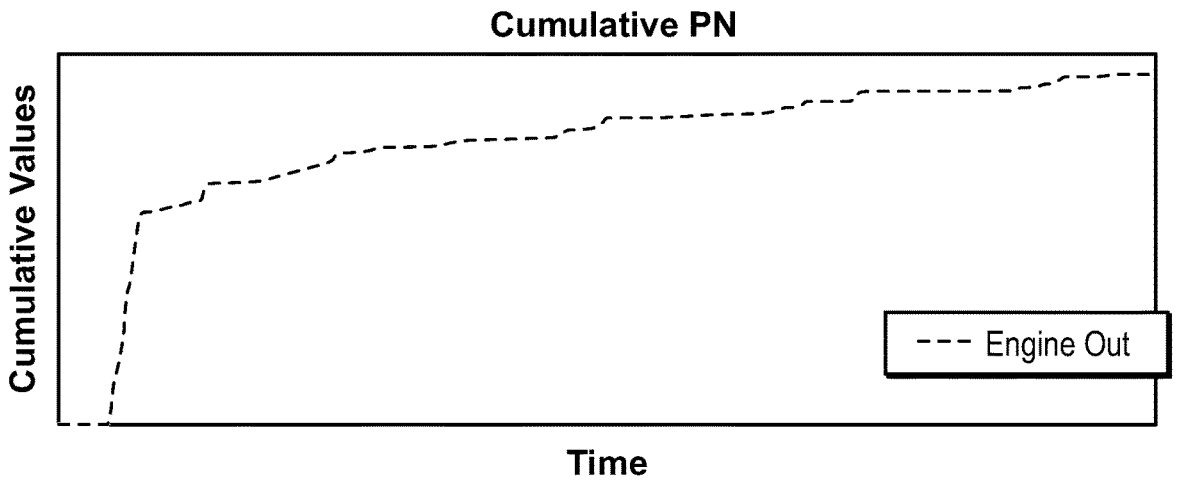
FIG. 5 shows the cumulative amount of Particulate Number (PN) as a function of time.

FIG. 5 shows the cumulative particulate number (PN) emissions at the tailpipe as a function of time using a single particulate filter, such as shown in FIG. 1. As shown, most of the PN emissions occurs in cold-start conditions when the temperature is too low to allow a good evaporation of the fuel inside the combustion chamber. Once the engine is hot, PN emissions still occur at high engine load but the amount emitted is limited as compared to cold-start conditions.

Thus, the present disclosure seeks to address this issue by including a second particulate filter in the exhaust purification system. As shown in FIG. 2, a second particulate filter 204 is located inside a bypass flow line 208. The second particulate filter 204 (and bypass flow line 208) are downstream of the first particulate filter 203, closer to the tailpipe 209. This may lower the operating temperature and backpressure. In one or more embodiments, the second particulate filter 204 may have a honeycomb structure similar to the first particulate filter, with channels blocks at alternate ends. The filtration may be performed only through the porosity of the filter as well. However, in accordance with one or more embodiments, the second particulate filter may have a lower porosity (such as 40-60% lower) than the first particulate filter, reduced mean pore size (such as 5-20 μm) and specific wall thickness (such as 5-15 millimetric inch). The selected porosity, pore size, and wall thickness may allow the second particulate filter to be able to retain soot in cold-start conditions (in contrast to the first particulate filter). As shown, bypass flow line 208 is in communication with the main exhaust gas line through valves 205 and 206. Upon opening valves 205 and 206, the exhaust gas is forced to flow through the walls of second particulate filter 204 between the channels, and the particulate matter is thereby retained.

Figure 6:
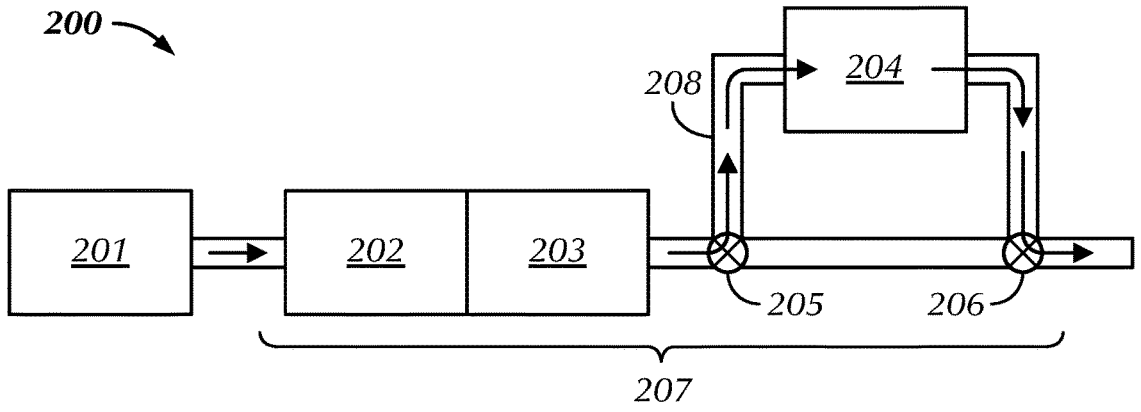
FIG. 6 illustrates when the bypass flow line is active and the whole exhaust gas flows through the second particulate filter.

FIG. 6 illustrates the exhaust purification system 200 when the bypass flow line 208 is active and the whole exhaust gas flows through the bypass flow line 208 and second particulate filter 204 through valves 205 and 206. Valves 205 and 206 may be 3-way valves. As shown in FIG. 5, cold start conditions may result in an increase in particulate number emissions at the tailpipe 209. Thus, in one or more embodiments, then in cold start conditions, the bypass valves 205 and 206 may be opened so that the exhaust gas may flow through the bypass line 208 and second particulate filter 204. The second particulate filter 204 may filter or capture at least a portion of the particulates that were not captured by the first particulate filter 203. The second particulate filter may have a lower porosity, reduced mean pore sizes, and wall thicknesses selected to filter at least a portion of the particulates that passed through the first particulate filter. Further, in addition to cold start conditions, it is also envisioned that the bypass line may be opened, such that exhaust gas passes through the second particulate filter at other times when the first particulate filter is not operating at a threshold efficiency, such as under hard acceleration. Thus, under these scenarios, valves 205 and 206 may be opened to allow communication between the main exhaust line and the bypass flow line 208 so that the exhaust gas is forced to flow through the second particulate filter 204.

Figure 7:
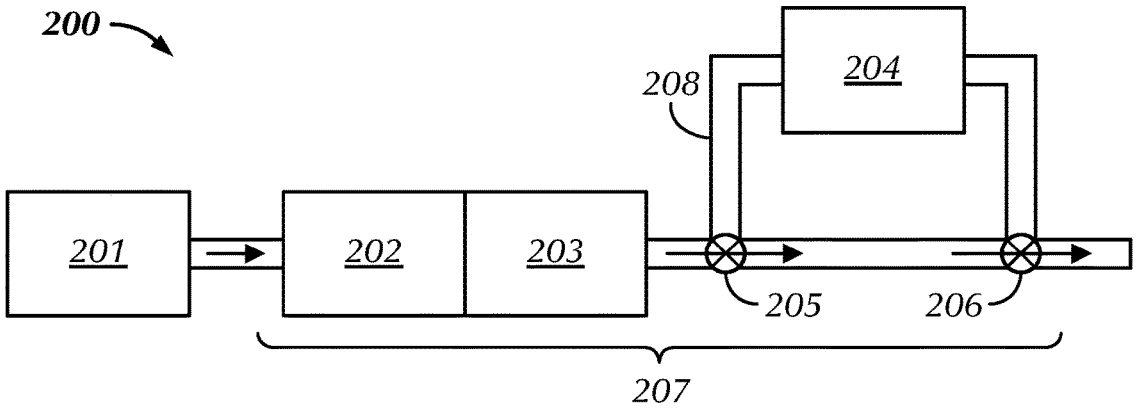
FIG. 7 illustrates when the bypass flow line is inactive and the whole exhaust gas flows in the main flow line.

Following the cold start conditions, once the first particulate filter has enough soot to improve its filtration efficiency, the first particulate filter 203 is capable of reducing the particulate number drastically such that the second particulate filter 204 is no longer needed. The bypass flow line 208 may be closed when an engine control unit estimates that a first particulate filter 203 has built a selected amount of soot cake. Thus, once this occurs, as shown in FIG. 7, valves 205 and 206 are closed, such that bypass flow line 208 is closed to exhaust gas. In addition to cold start conditions, the second particulate filter 204 may also be used after the regeneration of the first particulate filter 203 until the "wall filtration" stage (shown in FIG. 4) is reached. That is, immediately following regeneration, the filter efficiency of the first particulate filter 203 is temporarily reduced until a soot cake re-forms. Thus, the exhaust purification system 200 may be used in the state illustrated in FIG. 6 until the soot cake re-forms on the first particulate filter 203.

Detection of exhaust conditions (and triggering of the exhaust purification system 200 to operate between the state shown in FIG. 6, and that shown in FIG. 7) may occur by a control system 210 may further include any one of sensing mechanisms 212, 213, 214, as shown in FIG. 2, and a data processor 215 coupled with sensing mechanisms 212, 213, 214 and configured to receive inputs from sensing mechanisms 212, 213, 214. Further, while it is shown that a single sensing mechanism exists for each of engine 201, first particulate filter 203, and proximate tailpipe 209, it is understood that each component may include multiple sensing mechanisms. Data processor 215 may be part of an electronic control unit 216 which includes a dedicated filter control unit, but which might also comprise an engine control unit. In other words, electronic control unit 216 may be configured to monitor and control exhaust purification system 207 but might additionally be configured to monitor and control operating aspects of engine 201 as well as other components of the larger system or machine in which the engine and exhaust purification system operate. A computer readable memory 224 may be coupled with data processor 215, and stores computer readable code executed by data processor 215. The computer readable code may include a soot or emissions detection, engine condition and/or regeneration control algorithm. Memory 224 may include any form of suitable memory such as a hard drive, flash memory or the like. Data processor 215 receives data from the sensing mechanisms 212, 213, 214, which may indicate conditions of engine 201, relative soot loading state of first particulate filter 203, or emissions at tailpipe 209, such that data processor 215 may command operation of bypass valves 205 and 206 responsive to the relative soot loading state of filter, tailpipe emissions, and engine conditions, for example.

Upon any of such triggers, the bypass flow line 208 may be opened, and the second particulate filter 204 activated to ensure sufficient global efficiency at reducing soot emission. The bypass flow line 208 may remain open, for example until the soot sensor 213 indicates the first particulate filter 203 has rebuilt a soot cake for optimum filtration efficiency or during periods determined to be an engine heavy load. Alternatively, bypass flow line 208 may remain open until engine conditions measure a sufficient temperature, indicating an end of cold start conditions. Further, bypass flow line 208 may be opened when an engine control unit 216 estimates that a soot combustion has occurred in a first particulate filter 203. It is also envisioned that sensors may be at other locations. For example, a sensor may detect emissions after the first particulate filter (which may be at any location in the exhaust line, such as proximate the exit from first particulate filter or proximate tailpipe 209). For example, if the quantity of soot is too elevated (PN is too high) in the main flow line downstream of the first particulate filter 203, the bypass flow line 208 may be opened to force the exhaust gas into the second particulate filter 204 and decrease particulate emission.

Further, one or more embodiments of the present disclosure relate to the replacement of the second particulate filter 204. When the second particulate filter 204 has stored enough soot to reach a pre-determined backpressure value, the electronic control unit 216 may signal an indication to a user or operator of the engine 201 that the second particulate filter 204 needs to be replaced. Alternatively, the second particulate filter 204 could be located close enough to the first particulate filter 203 so that it can be regenerated at the same time as the first particulate filter 203.

In one or more embodiments, the second particulate filter 204 is configured to be removed and replaced when full (or having a predetermined quantity of soot present therein). As the operating time of the second particulate filter 204 increases, the filter 204 stores an increasing amount of soot, which can lead to overloading. This overload may disturb the engine, reduce its power, and increase fuel consumption as mentioned above. Further, as the filter 204 is closer to the tailpipe to reduce its temperature and backpressure, the opportunities to burn soot (and regenerate the filter 204) are reduced. Therefore, when it is loaded of soot, the second particulate filter 204 may be replaced with a new filter during the vehicle maintenance. It is envisioned that the second particulate filter 204 can be installed in a cartridge to facilitate its replacement and the soots disposed of following an environmentally friendly procedure.

EXAMPLES

Figure 8:
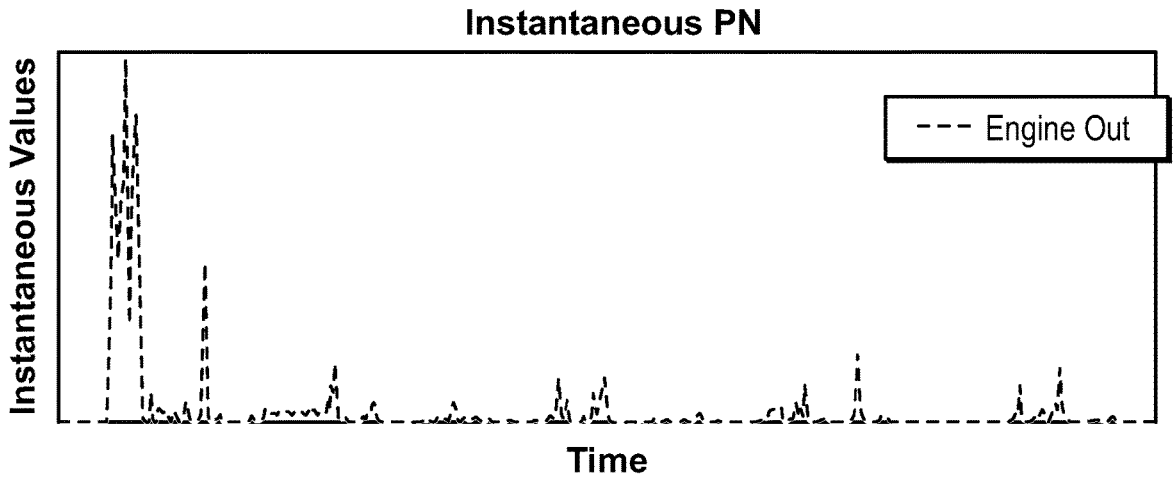
FIG. 8 shows the instant value of the Particulate Number (PN) as a function of time.

FIG. 8 shows the instant value of the Particulate Number (PN) as a function of time when the exhaust purification system has only a catalyst and one particulate filter. Most of the PN emission occurs under cold-startup condition, when the first particulate filter has not reached its operating temperature yet. Once the particulate filter is at operating temperature, the amount of PN emitted during hard acceleration is limited as compared to cold-startup conditions.

Figure 9:
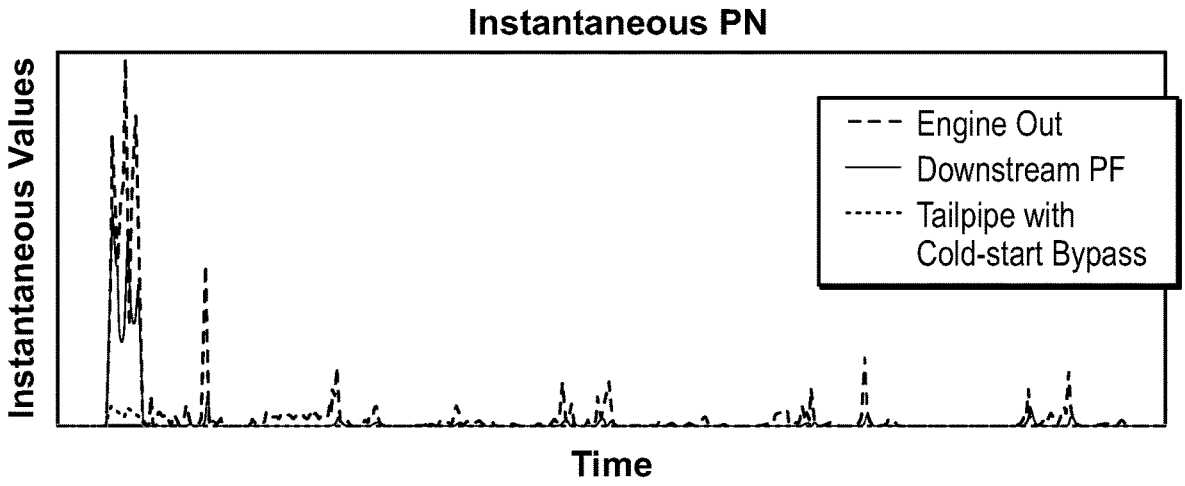
FIG. 9 shows the instant value of the particulate number in cold-start conditions measured after the engine (in large dotted line), measured after the first particulate filter (in full line) and after the second particulate filter (bPF) (in short dotted line).

In contrast, when the exhaust purification system has the additional second particulate filter, the reduction of particulate number after the second particulate filter is significant. FIG. 9 shows the instant value of the particulate number in cold-start conditions measured after the engine (in large dotted line), measured after the first particulate filter (in full line), and after the second particulate filter (in short dotted line). In cold-start conditions, the reduction of particulate number after the second particulate filter is dramatic as compared to the measured values after the first particulate filter.

Figure 10:
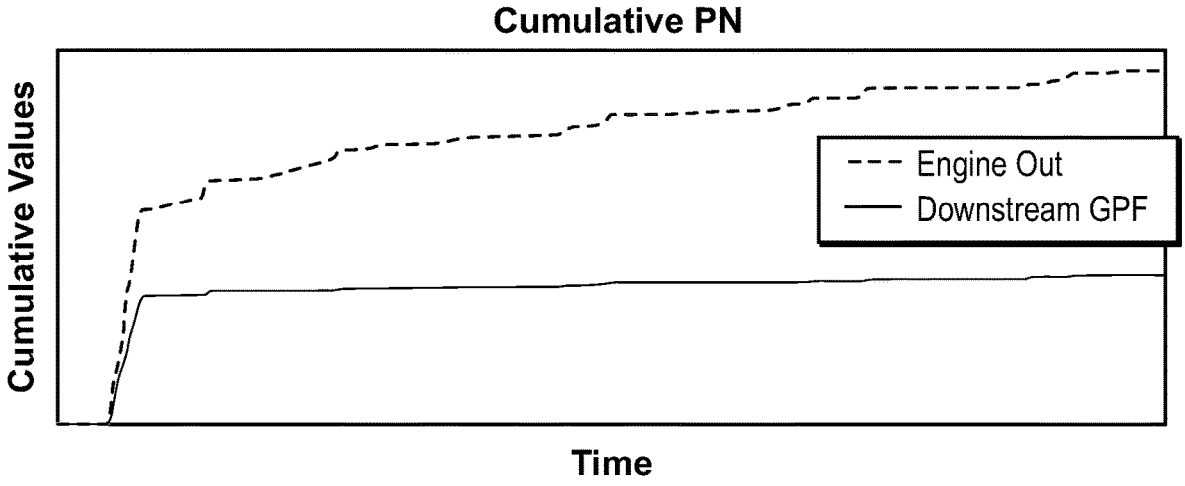
FIG. 10 shows the cumulative amount of Particulate Number (PN) as a function of time before the first catalyst (in large dotted line) and after the first particulate filter (in full line).
Figure 11:
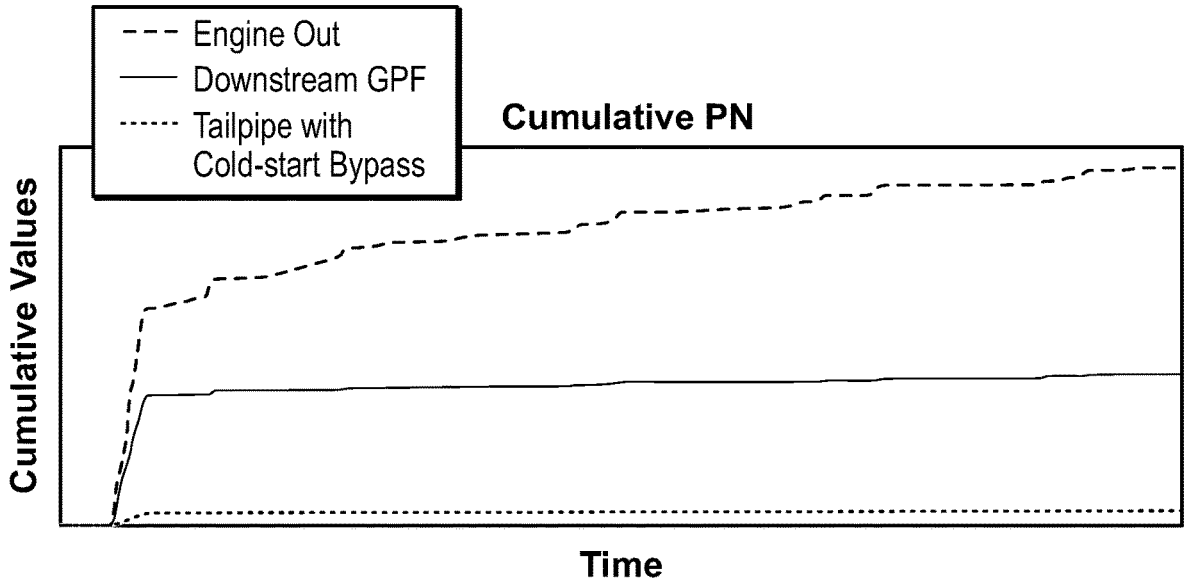
FIG. 11 shows the cumulative amount of Particulate Number (PN) as a function of time before the first catalyst (in large dotted line), after the first particulate filter (in full line) and after the second particulate filter (in short dotted line).

The efficiency of one or more embodiments can be appreciated by comparing FIGS. 10 and 11. FIG. 10 shows the cumulative amount of Particulate Number (PN) as a function of time before the exhaust purification system (in large dotted line) and after the first particulate filter (in full line). More than 50% of the cumulative amount of particulate number emitted by the engine is captured when the exhaust purification system contains a catalytic converter and a first particulate filter.

In contrast, FIG. 11 shows the cumulative amount of Particulate Number (PN) as a function of time before the exhaust purification system (in large dotted line), after the first particulate filter (in full line) and after the second particulate filter (in short dotted line). When the second particulate filter is added to the exhaust purification system as described herein, the cumulative amount of particulate number emitted is one order of magnitude lower, i.e., ten times lower, than after the first particulate number.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. An exhaust purification system, comprising:

at least one catalyst in an exhaust flow path of an internal combustion engine to decrease gaseous pollutants from an exhaust gas;

a first particulate filter downstream of the at least one catalyst to decrease solid pollutants from the exhaust gas; and a second particulate filter with a lower porosity or lower mean pore size, or a combination thereof, than the first particulate filter and in a bypass flow line downstream of the first particulate filter, the bypass flow line being configured to open and close using two valves located in the bypass flow line based on at least one condition of the exhaust purification system or conditions of the exhaust gas;

wherein the bypass flow line is closed when an engine control unit estimates that a soot cake has formed when the soot is stored inside the inlet channels of the first particulate filter after the wall of the filter is fully loaded of soot.

2. The exhaust purification system of claim 1, wherein the second particulate filter has a honeycomb structure with a porosity ranging from 40% to 60% lower than the first particulate filter, a reduced mean pore size ranging from 5 μm to 20 μm and a wall thickness ranging from 5 millimetric inch to 15 millimetric inch.

3. The exhaust purification system of claim 1, wherein the second particulate filter is located close to the first particulate filter.

4. The exhaust purification system of claim 1, wherein the second particulate filter is located close to an exit of the exhaust flow path.

5. The exhaust purification system of claim 1, further comprising:

at least one sensor located after the first particulate filter and before the bypass flow line to measure relative soot loading state of the first particulate filter to indicate when the first particulate filter has rebuilt a soot cake.

6. The exhaust purification system of claim 5, wherein the second particulate filter has a honeycomb structure with a porosity ranging from 40% to 60% lower than the first particulate filter, a reduced mean pore size ranging from 5 μm to 20 μm and a wall thickness ranging from 5 millimetric inch to 15 millimetric inch.

7. The exhaust purification system of claim 1, further comprising:

at least one sensor located close to an exit of the exhaust flow path to measure tailpipe emissions.

* * * * *